US007939010B2

(12) United States Patent
James et al.

(10) Patent No.: US 7,939,010 B2
(45) Date of Patent: May 10, 2011

(54) METHOD FOR FORMING FIBERS

(75) Inventors: Michael David James, Cincinnati, OH (US); Stanford Royce Jackson, Fairfield, OH (US); Savas Aydore, West Chester, OH (US); Hasan Eroglu, West Chester, OH (US); Donald Eugene Ensign, Cincinnati, OH (US); Paul Dennis Trokhan, Cincinnati, OH (US); Edwin Arthur Stewart, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 898 days.

(21) Appl. No.: 11/281,282

(22) Filed: Nov. 17, 2005

(65) Prior Publication Data

US 2006/0091582 A1 May 4, 2006

Related U.S. Application Data

(62) Division of application No. 10/411,481, filed on Apr. 8, 2003, now Pat. No. 7,018,188.

(51) Int. Cl.

| | |
|---|---|
| ***D01D 5/088*** | (2006.01) |
| ***D01D 5/098*** | (2006.01) |
| ***D01D 5/253*** | (2006.01) |
| ***D01F 4/00*** | (2006.01) |

(52) U.S. Cl. ..... 264/555; 264/177.13; 264/210.8; 264/211.14

(58) Field of Classification Search ..... 264/210.7, 264/210.8, 211.14, 211.17, 211.22, 103, 264/177.13, 555

See application file for complete search history.

(56) References Cited

U.S. PATENT DOCUMENTS

| | | | | |
|---|---|---|---|---|
| 1,310,509 | A | 7/1919 | Specht | |
| 2,991,168 | A * | 7/1961 | Nadel | 149/2 |
| 3,379,811 | A | 4/1968 | Hartmann et al. | |
| 3,437,725 | A | 4/1969 | Pierce | |
| 3,441,468 | A | 4/1969 | Siggel et al. | |
| 3,692,618 | A | 9/1972 | Dorschner et al. | |
| 3,737,506 | A | 6/1973 | Martin et al. | |
| 3,755,527 | A | 8/1973 | Keller et al. | |
| 3,758,658 | A | 9/1973 | Riggert | |
| 3,802,817 | A | 4/1974 | Matsuki et al. | |

(Continued)

FOREIGN PATENT DOCUMENTS

EP 0 495 466 B1 7/1992

(Continued)

OTHER PUBLICATIONS

W. John G. McCulloch, Ph.D., The History of the Development of Melt Blowing Technology, INJ Spring 1999, pp. 66-72.

(Continued)

*Primary Examiner* — Leo B Tentoni

(74) *Attorney, Agent, or Firm* — C. Brant Cook; David M. Weirich

(57) ABSTRACT

An improved method for creating fibers from a material dissolved in a solvent. In one embodiment, the method includes the steps of feeding a fiber making material dissolved in a solvent through a die including at least two rows of nozzles to form fiber strands. An attenuation medium is provided about the fiber strands. The attenuation medium is provided in a direction that is generally parallel to the fiber strands such that the attenuation medium elongates the fiber strands. The attenuation medium has a relative solvent-vapor content of at least about 50 percent.

20 Claims, 9 Drawing Sheets

U.S. PATENT DOCUMENTS

| | | | | |
|---|---|---|---|---|
| 3,825,379 | A | 7/1974 | Lohkamp et al. | |
| 3,825,380 | A | 7/1974 | Harding et al. | |
| 3,849,241 | A | 11/1974 | Butin et al. | |
| 3,888,610 | A | 6/1975 | Brackmann et al. | |
| 3,954,361 | A | 5/1976 | Page | |
| 3,970,417 | A | 7/1976 | Page | |
| 4,168,138 | A | 9/1979 | McNally | |
| 4,295,809 | A | 10/1981 | Mikami et al. | |
| 4,380,570 | A | 4/1983 | Schwarz | |
| 4,486,161 | A | 12/1984 | Middleton | |
| 4,622,259 | A | 11/1986 | McAmish et al. | |
| 4,818,463 | A | 4/1989 | Buehning | |
| 4,818,466 | A | 4/1989 | Mente et al. | |
| 4,826,415 | A | 5/1989 | Mende | |
| 4,826,416 | A | 5/1989 | Majerus et al. | |
| 4,847,035 | A | 7/1989 | Mente et al. | |
| 4,855,179 | A | 8/1989 | Bourland et al. | |
| 4,889,476 | A | 12/1989 | Buehning | |
| 4,986,743 | A | 1/1991 | Buehning | |
| 5,017,112 | A | 5/1991 | Mende et al. | |
| 5,087,186 | A | 2/1992 | Buehing | |
| 5,098,636 | A | 3/1992 | Balk | |
| 5,112,562 | A | 5/1992 | Mende | |
| 5,122,048 | A | 6/1992 | Deeds | |
| 5,160,746 | A | 11/1992 | Dodge, II et al. | |
| 5,165,940 | A | 11/1992 | Windley | |
| 5,171,512 | A | 12/1992 | Mende et al. | |
| 5,286,162 | A | 2/1994 | Veres | |
| 5,405,559 | A | 4/1995 | Shambaugh | |
| 5,445,785 | A * | 8/1995 | Rhim | 264/555 |
| 5,476,616 | A | 12/1995 | Schwarz | |
| 5,523,033 | A | 6/1996 | Shambaugh | |
| 5,652,048 | A | 7/1997 | Haynes et al. | |
| 5,679,379 | A | 10/1997 | Fabbricante et al. | |
| 5,688,468 | A | 11/1997 | Lu | |
| 5,725,812 | A | 3/1998 | Choi | |
| 5,902,540 | A | 5/1999 | Kwok | |
| 5,935,512 | A | 8/1999 | Haynes et al. | |
| 5,951,942 | A | 9/1999 | Rossillon et al. | |
| 6,013,223 | A | 1/2000 | Schwarz | |
| 6,168,409 | B1 | 1/2001 | Fare | |
| 6,244,845 | B1 | 6/2001 | Milligan et al. | |
| 6,247,911 | B1 | 6/2001 | Milligan | |
| 6,306,334 | B1 | 10/2001 | Luo et al. | |
| 6,364,647 | B1 | 4/2002 | Sanborn | |
| 6,491,507 | B1 | 12/2002 | Allen | |
| 6,811,740 | B2 * | 11/2004 | James et al. | 264/555 |
| 2001/0026815 | A1 | 10/2001 | Suetomi | |
| 2003/0146537 | A1 | 8/2003 | James et al. | |
| 2004/0201127 | A1 | 10/2004 | James et al. | |
| 2005/0048152 | A1 | 3/2005 | Gerking | |
| 2009/0221006 | A1 | 9/2009 | Gerking | |

FOREIGN PATENT DOCUMENTS

| | | |
|---|---|---|
| WO | WO 00/20674 | 4/2000 |
| WO | WO 99/34039 | 7/2009 |

OTHER PUBLICATIONS

Jayesh Natwarial Doshi, Ph.D., The Electrospinning Process and Applications of Electrospun Fibers, University Microfilms International, Aug. 1994.

Jayesh Natwarial Doshi, Ph.D., et al., The Electrospinning Process and Applications of Electrospun Fibers, IEEE Industry Applications, 1993, pp. 1698-1703.

Jayesh Natwarial Doshi, Ph.D., et al., The Electrospinning Process and Applications of Electrospun Fibers, The Journal of Electrostatics, 35, 1995, pp. 151-160.

* cited by examiner

METHOD FOR FORMING FIBERS

CROSS REFERENCE TO RELATED APPLICATIONS

This application is a divisional application of U.S. application Ser. No. 10/411,481, filed Apr. 8, 2003 now U.S. Pat. No. 7,018,188.

FIELD OF THE INVENTION

The invention relates generally to a method for forming fibers.

BACKGROUND OF THE INVENTION

Manufactured fibers and nonwoven textiles including such fibers have many different uses in commercial and consumer products. For example, manufactured fibers are often used in absorbent articles such as diapers, feminine hygiene articles, wipes, clothing, packaging, towels, tissue, surgical wraps and gowns, wall coverings, automotive, aeronautic, military and nautical applications, as well as building materials, writing media, filters and insulation. Due to the demand for manufactured fibers of different types having different characteristics, a number of fiber forming methods and apparatuses have been developed.

Some of the most popular fiber forming techniques include melt-blowing, wet spinning and dry spinning. In each of these methods, the fiber material is softened into a flowable state and forced through a die and/or spinnerette to form embryonic fibers that are then typically mechanically stretched to form the desired end fibers. Melt-blowing of fibers generally includes melting a thermoplastic material, forming a fiber and then cooling the thermoplastic material to form solid fibers. Wet spinning generally involves extruding fibers formed from a solution of polymer and solvent into a coagulating bath, such as a solution of sodium sulfate in water. Dry spinning typically involves extruding a solution of polymer and solvent into air to form solid fibers. The fibers formed by these methods are often collected on a surface such as a belt to form a nonwoven web or are otherwise treated chemically or mechanically manipulated to change or enhance their properties. Examples of methods and apparatuses for melt-blowing and spinning fibers are described in U.S. Pat. No. 3,825,379 issued to Lohkamp; U.S. Pat. Nos. 4,826,415 and 5,017,112 issued to Mende; U.S. Pat. No. 5,445,785 issued to Rhim; U.S. Pat. Nos. 4,380,570; 5,476,616 and 6,013,223 issued to Schwarz and U.S. Pat. No. 6,364,647 B1 issued to Sanborn.

However, despite the success of such known methods and apparatuses, there is a need in the art for improvement. For example, it would be desirable to provide a method and apparatus for more efficiently forming fibers. It would also be desirable to provide a method and apparatus for forming smaller and/or more uniformly sized fibers. Further, it would be desirable to provide a method and apparatus for forming fibers, wherein the pressure drop associated with the attenuation medium in the die is relatively small as compared to known fiber making apparatuses and methods. It would also be desirable to provide a method and apparatus of forming fibers wherein a reduction in the pressure difference between the attenuation medium inside the apparatus and after it exits the apparatus allows for higher relative solvent-vapor content levels in the attenuation medium in the attenuation region as compared to existing fiber forming methods and equipment. Even further, it would be desirable to provide a method and apparatus for forming fibers from non-thermoplastic and/or solvent-soluble materials. Further yet, it would be desirable to provide a high throughput die apparatus including multiple rows of spinning orifices that can form fibers from non-thermoplastic and/or solvent-soluble materials. Still further, it would be desirable to provide a method and apparatus for forming fibers wherein a low pressure drop associated with the attenuation medium in the die provides for high relative solvent-vapor content levels even when the flow rate and/or velocity of the attenuation medium is similar to conventional dies.

SUMMARY OF THE INVENTION

It has been found that the method of the present invention may solve the shortcomings of the prior art and provide an improved method for making fibers. Specifically, in one embodiment, the present invention provides an improved method for creating fibers from a material dissolved in a solvent, the method including the following steps: feeding a fiber making material dissolved in a solvent through a die including at least two rows of nozzles to form fiber strands; and providing an attenuation medium about the fiber strands, the attenuation medium being provided in a direction that is generally parallel to the fiber strands such that the attenuation medium elongates the fiber strands, the attenuation medium having a relative solvent-vapor content of at least about 50 percent.

In another embodiment, the present invention provides an improved method for creating fibers from a material dissolved in a solvent, the method including the following steps: feeding a fiber making material dissolved in a solvent through a die including at least two rows of nozzles and a cover plate having a cover plate opening to form fiber strands; providing an attenuation medium through the cover plate opening at a velocity of between about 90 and about 350 m/s, the attenuation medium being provided in a direction that is generally parallel to the fiber strands such that the attenuation medium elongates the fiber strands; and wherein the attenuation medium has a pressure drop coefficient of less than about 4.

In yet another embodiment, the present invention provides an improved method for creating fibers from a material dissolved in a solvent, the method including the following steps: feeding a fiber making material dissolved in a solvent through one or more nozzles to form fiber strands; providing an attenuation medium about the fiber strands, the attenuation medium being provided in a direction that is generally parallel to the fiber strands such that the attenuation medium elongates the fiber strands, the attenuation medium experiencing a pressure drop prior to contacting the fiber strands; and cooling the attenuation medium after the attenuation medium experiences the pressure drop.

DETAILED DESCRIPTION OF THE INVENTION

Figure 1:
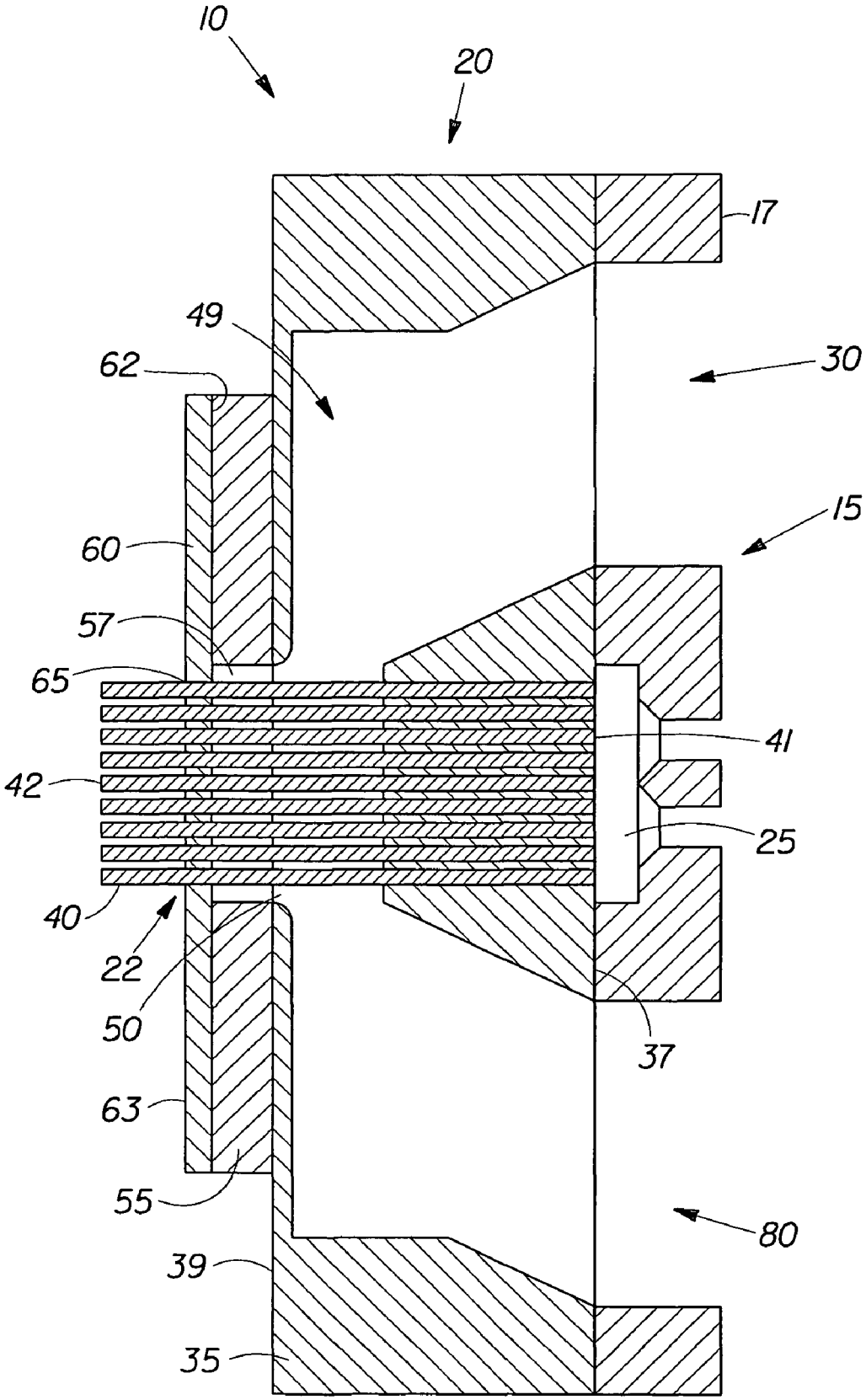
FIG. 1 is an enlarged, cross-sectional view of one embodiment of the apparatus of the present invention.

As noted above, the method and apparatus of the present invention are directed generally to the manufacture of fibers and textiles, and products including such fibers. The apparatus and method of the present invention may be used to produce all of the different types of fibers mentioned above, including melt-blown fibers, dry spun fibers and/or wet spun fibers. However, the apparatus and method are particularly suited for producing fibers from non-thermoplastic or pseudo-thermoplastic materials, such as materials that are made flowable by dispersing, suspending or dissolving the material in a solvent. As used herein, the term "non-thermoplastic" refers to a material requiring a solvent to soften the material to such a degree that the material can be brought into a flowing state such that it can be shaped as desired, and more specifically, processed (for example, by spinning) to form a plurality of non-thermoplastic fibers suitable for forming a flexible fibrous structure. A non-thermoplastic composition cannot be brought into a required flowing state by the influence of elevated temperatures alone. While a non-thermoplastic composition may include some amounts of other components, such as, for example, plasticizers, that can facilitate flowing of the non-thermoplastic composition, these amounts by themselves are not sufficient to bring the non-thermoplastic composition as a whole into a flowing state in which it can be processed to form suitable non-thermoplastic fibers. A non-thermoplastic composition also differs from a thermoplastic composition in that once the solvent is removed from the non-thermoplastic composition, for example, by drying, and the material reaches a solidified state, it loses its thermoplastic-like qualities. When the composition comprises a cross-linker, the material with the solvent removed becomes, in effect, a cross-linked thermosetting composition. A product, such as, for example, a plurality of fibers made of such a non-thermoplastic composition, does not, as a whole, exhibit a melting point and does not, as a whole, have a melting temperature (characteristic of thermoplastic compositions); instead, the non-thermoplastic product, as a whole, decomposes without ever reaching a flowing state as its temperature increases to a certain degree ("decomposition temperature"). In contrast, a thermoplastic composition retains its thermoplastic qualities regardless of the presence or absence of a solvent and can reach its melting point ("melting temperature") and become flowable as its temperature increases.

For example, the apparatus and method of the present invention are well suited for materials that are solvent-soluble, and thus, dissolved in a solvent prior to being forced through the die/spinnerette combination to form fiber strands. Often it is desirable to attenuate, or stretch, the fibers exiting the spinnerette. However, when using current technology to form fibers from non-thermoplastic, solvent-soluble materials, it can be difficult to maintain enough relative solvent-vapor content in the attenuation region of the process to allow for the desired stretching of the fibers. (As used herein, the "relative solvent-vapor content" is the partial pressure of solvent in vapor form in the attenuation medium divided by the equilibrium vapor pressure of the solvent at the specified temperature and pressure. For the case of water vapor in air, the relative solvent-vapor content is commonly referred to as the relative humidity.) This can be even more difficult while using equipment designed for the multi-row, high throughput rates desirable for commercial manufacture of fibers. Although not wishing to be bound by theory, this problem is believed to be in part the result of a significant pressure drop in the attenuation medium within the die. (Although the attenuation medium may be any flowable medium, such as air, any gas or mixture of gasses, liquid or other fluid medium, typical fiber forming processes use air as the attenuation medium. Thus, although the attenuation medium may be described as air or a gas hereinafter, it should be recognized that any suitable attenuation medium can be used and that a reference to air or gas should not be considered limiting, but rather as one example of a suitable attenuation medium. Further, although certain examples of fiber making materials may be described herein as water-soluble, the fiber making material can be any suitable material and the solvent, if any, can be any suitable solvent.)

In a typical melt blowing die, where the attenuation medium passes through the die body, the attenuation medium is at elevated pressures, (e.g. greater than ambient pressure), prior to exiting the die. Due to the relationship between pressure, temperature and relative solvent-vapor content (often referred to as psychrometric equilibrium), less solvent vapor is carried by the attenuation medium at the elevated pressures. Typically, excess solvent-vapor will condense when the attenuation medium is at elevated pressures in the die. This reduces the maximum amount of solvent-vapor carried in the pressurized attenuation medium. Thus, when the attenuation medium exits the die and expands to ambient pressure, the relative solvent-vapor content of the attenuation medium will be reduced as compared to an attenuation medium stream that was not at an elevated pressure within the die.

In typical spinning operations, the amount of relative solvent-vapor content in the attenuation medium is not particularly relevant because the fibers are made from thermoplastic materials and are solidified by a drop in temperature rather than drying. In such operations, it is generally important to maintain the fibers at a temperature at or above their melt point for a period of time such that the attenuation air can stretch the fibers, as desired. Accordingly, the attenuation medium (e.g. air) is often heated or alternative heat sources are provided to ensure that the fibers do not solidify before being stretched. However, in operations directed to making non-thermoplastic or pseudo-thermoplastic fibers, it may be desirable to provide high relative solvent-vapor content levels in the attenuation medium to prevent the fibers from drying too quickly and breaking before the desired attenuation can be achieved. When making non-thermoplastic fibers, the fiber temperature is not the dominant factor affecting the solidification of the fibers. Rather, the loss of solvent, which is influenced by the surrounding relative solvent-vapor content, plays a dominant role in fiber solidification.

The apparatus and method of the present invention provide a solution to this problem by providing a means for reducing the pressure drop associated with the attenuation medium in the die. This allows the attenuation medium to maintain a higher solvent-vapor content in the attenuation region. Accordingly, especially when used with non-thermoplastic, solvent-soluble materials, the apparatus and method of the present invention can help ensure that the fibers are not dried too quickly. This can help ensure that the fibers that are formed have the desired characteristics such as diameter and uniformity, can help prevent the fibers from breaking and/or help prevent the die from becoming clogged. These and other advantages of the apparatus and method of the present invention can be especially beneficial when the fibers are being formed in multiple rows and/or at high throughput rates.

Referring to FIG. 1, one embodiment of the apparatus of the present invention, generally indicated as apparatus (or die) 10, is shown. The apparatus 10 includes a die assembly 15, a spinnerette assembly 20 and an attenuation medium exit 22. The apparatus 10 is designed to supply both the material from which fibers are formed and an airstream (or other attenuation medium stream) for attenuating the fiber strands. More specifically, the die assembly 15 includes a die body 17 and a supply cavity 25 formed in the die body 17. The supply cavity 25 is preferably operatively associated with one or more devices that supplies to the die assembly 15 the material from which the fibers are made. The die assembly 15 preferably also includes at least one attenuation medium inlet 30 through which the attenuation medium may pass. The attenuation medium inlet 30 is preferably operatively associated with at least one source of air, gas or other fluid that will be used as the attenuation medium when forming the fibers. The exit 22 is the location at which the attenuation medium exits the overall structure of the apparatus 10.

Figure 2:
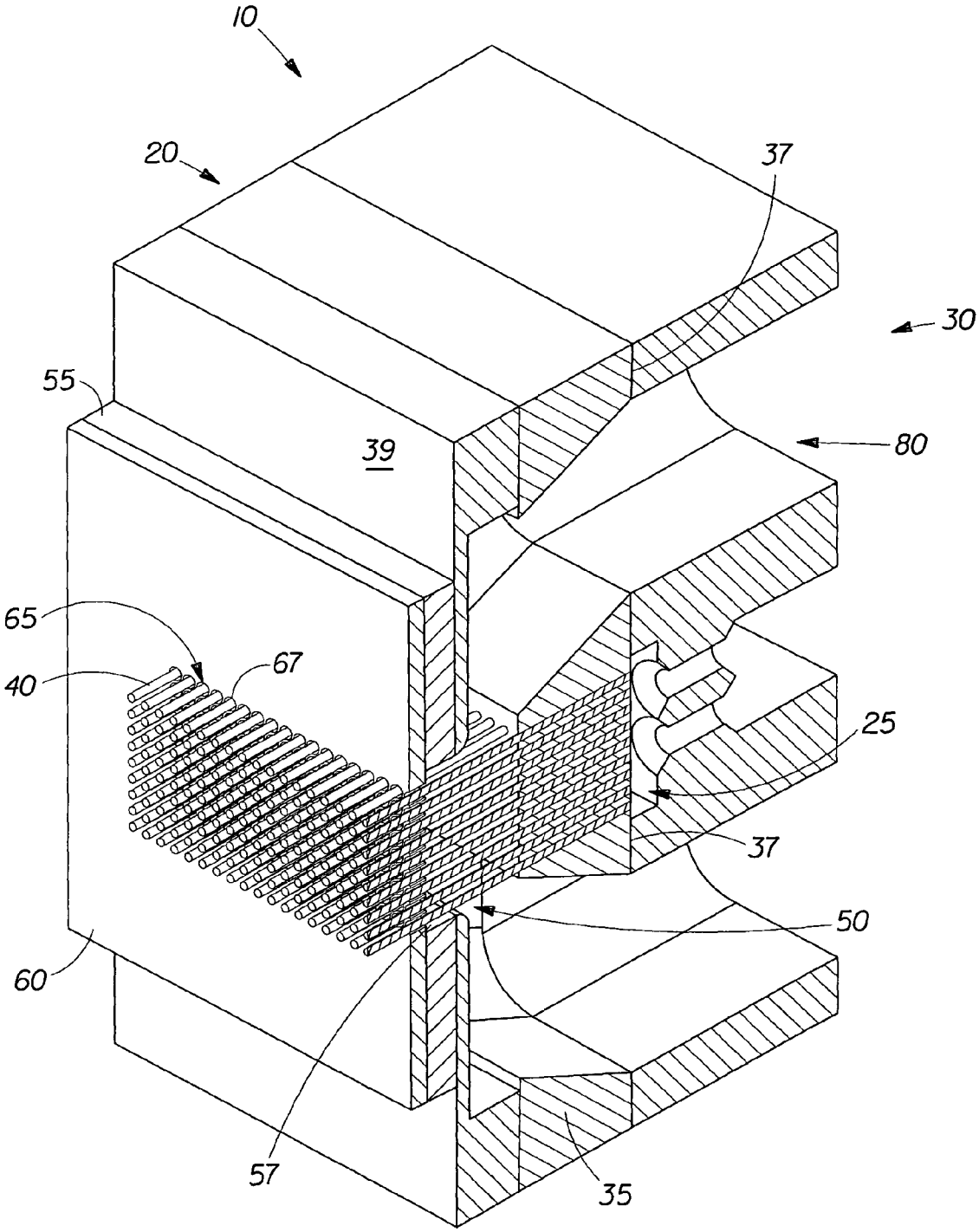
FIG. 2 is an enlarged, perspective view of one embodiment of the apparatus of the present invention.

The spinnerette assembly 20 includes a spinnerette body 35, one or more nozzles 40, at least one attenuation medium passage 80 and a discharge opening 50. The spinnerette body 35 has a die facing surface 37 and an opposed output surface 39. The spinnerette assembly 20 is generally disposed such that at least a portion of the die facing surface 37 is adjacent at least a portion of the die assembly 15. As shown in FIG. 1, at least some of the nozzles 40 are preferably in fluid communication with the supply cavity 25 of the die assembly 15. (By "fluid communication" it is meant that a fluid disposed in the supply cavity 25 can flow or be forced to flow into at least one of the nozzles 40.) Further, at least one of the attenuation medium passages 80 is in fluid communication with one or more of the attenuation medium inlet 30 structures such that the attenuation medium can flow from the die assembly 15 into the spinnerette assembly 20. The spinnerette assembly 20 can be made from a single element or can be made from or include two or more individual elements (e.g. as is shown in FIG. 2) that are temporarily or permanently joined with each other.

The spinnerette body 35 has a discharge opening 50 in the output surface 39 generally opposed to the portion of the spinnerette assembly 20 that is disposed adjacent the die assembly 15. In certain embodiments, at least some of the nozzles 40 are mounted in the spinnerette assembly 20 such that a portion of one or more of the nozzles 40 extends into or through the discharge opening 50. Typically, the nozzles 40 will be spaced apart from each other and preferably the spinnerette body 35 such that each nozzle 40 is at least partially surrounded by the attenuation medium passing through the discharge opening 50, when the die 10 is in use.

As noted above, the nozzle(s) 40 preferably form part of the spinnerette assembly 20. Typically, the nozzles 40 are mounted to the spinnerette body 35 such that they extend entirely through the spinnerette assembly 20. Thus, as shown in FIG. 1, the nozzles 40 extend from the die facing surface 37 of the spinnerette body 35 through the spinnerette body 35 toward the output surface 39 of the spinnerette assembly 20. (However, embodiments are contemplated wherein the nozzles 40 do not extend through the entire spinnerette body 35, but only a portion thereof.) The nozzles 40 may also pass into or through one or more of the attenuation medium passages 80 and preferably extend at least partially into the discharge opening 50. In certain embodiments, at least some of the nozzles 40 extend beyond the discharge opening 50 and away from the spinnerette body 35. In any case, at least some of the nozzles 40 may have lengths different than at least some of the other nozzles 40 and may extend beyond the discharge opening 50 differing amounts. Further, in some embodiments, it may be desirable to have at least some nozzles 40 blocked or made from a solid structure with no opening through which fiber making material will pass or otherwise not in fluid communication with the supply cavity 25.

Figure 3:
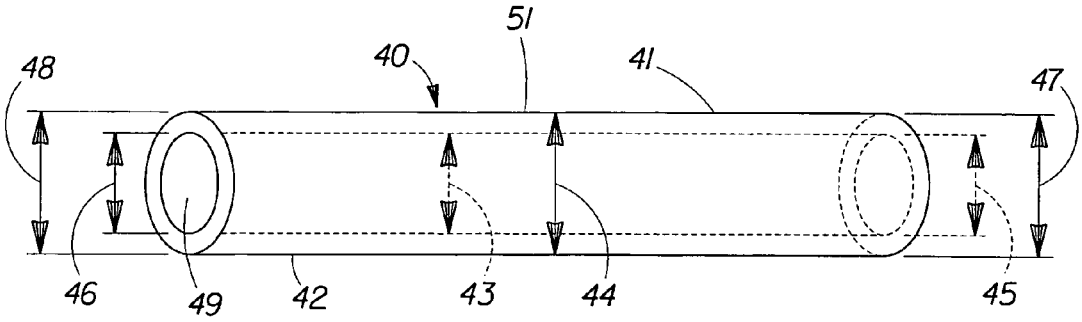
FIG. 3 is an enlarged, perspective view of an exemplary nozzle of the present invention.

As shown in FIG. 3, the nozzles 40 each have an outer structure 51, a nozzle opening 49, an upstream end 41, a downstream end 42. As used herein, the term "upstream" refers generally to the beginning part of the manufacturing process, often wherein raw materials are added to the process. The term "downstream" refers generally to the part of the process where the end product is put in its final form and removed from the manufacturing process. Thus, an upstream end or portion of a component would be located more toward the beginning part of the manufacturing process than a corresponding downstream end or portion of the same component. If the particular nozzle 40 is intended to allow passage of fiber making material there through (i.e. has nozzle opening 49 and is not blocked), it will also have an inner effective diameter 43 and an outer effective diameter 44. Further, each nozzle 40 has an upstream end inner effective diameter 45, an upstream end outer effective diameter 47, a downstream end inner effective diameter 46 and a downstream end outer effective diameter 48. As used herein, the term "effective diameter," as it relates to a nozzle 40, is defined as four times the cross-sectional area of the nozzle opening 49 divided by the wetted perimeter of the nozzle opening 49. The term "cross-sectional area" as it relates to a nozzle, is the cross-sectional area of the nozzle 40 (for outer effective diameter measurements) or nozzle opening 49 (for inner effective diameter measurements) taken substantially perpendicular to the direction of fiber making material travel in the nozzle 40. The cross-sectional area of a nozzle 40 having some structure located within the nozzle opening 49 is the cross-sectional area that is open to fiber material flow and thus, the cross-sectional area of any structure located within the cross-section of the nozzle opening 49 should be subtracted.

Figure 6:
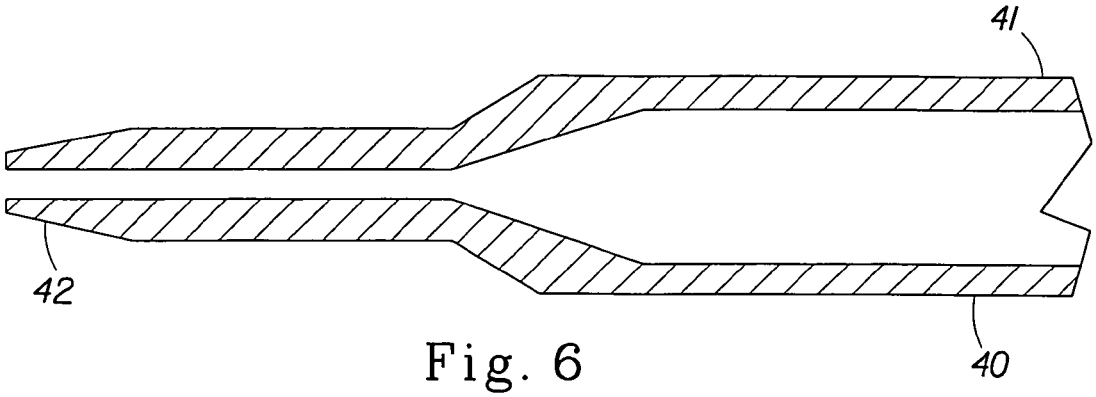
FIG. 6 is an enlarged, partial plan view of one exemplary nozzle of the present invention.

The nozzles 40 may be formed from small metal tubes having generally circular cross-sections. Alternatively, the outer structure 51 and/or nozzle opening 49 of any particular nozzle 40 may have any cross-sectional shape, may have varying inner and/or outer effective diameters, as shown in FIG. 6, may be tapered (e.g. the downstream outer effective diameter is less than the upstream outer effective diameter) or beveled and may be made from any suitable material. The nozzles 40 may all have the same upstream inner and/or outer effective diameter or may have different upstream inner and/or outer upstream effective diameters. Likewise, the nozzles 40 may all have the same downstream inner and/or outer effective diameter or may have different upstream inner and/or outer downstream effective diameters. Further, the nozzles 40 may be the same length or may be different lengths and/or may be mounted so at to extend from the die 10 different amounts. The nozzles 40 may be made from a separate material that is mounted or otherwise joined to the spinnerette body 35 or may be formed in the material making up the spinnerette body 35 itself. The nozzles 40 may be permanently mounted to the spinnerette body 35 or may be removable and/or replaceable. Exemplary methods for mounting nozzles 40 in the spinnerette body 35 include, but are not limited to, laser welding, soldering, gluing, pressure fitting and brazing. Further, the nozzles 40 may be made from flexible materials, include one or more hinges 91 (e.g. as shown in FIG. 4*b*) or be flexibly mounted within the spinnerette body 35. Such nozzles 40 may be able to self-center during operation of the die 10.

In one exemplary embodiment, as shown in FIG. 2, the nozzles 40 are disposed in multiple adjacent rows, wherein each row includes a multiplicity of nozzles 40. Although FIG. 2 shows the nozzles 40 disposed in regular rows with equal numbers of nozzles 40 in each row, any suitable number of nozzles 40 may be in any particular row. Further, there may be some uses in which a single row of nozzles 40 is preferred. The nozzles 40 may be spaced apart any desired distance. Further, the nozzles 40 may be disposed in regular rows and or columns, or may be arranged in random and/or non-uniform patterns, or combinations thereof.

Figure 4A:
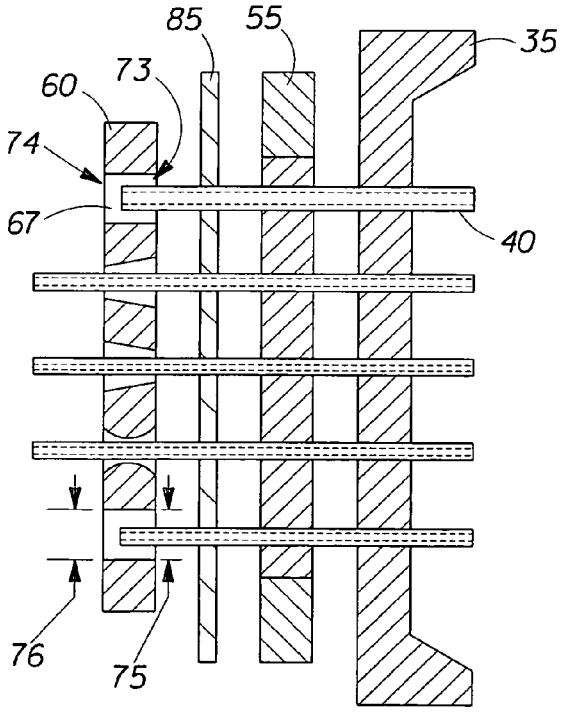
FIG. 4*a* is an enlarged, cross-sectional partial view of one embodiment of the die of the present invention with the individual elements spaced apart from each other so as to provide more detail.
Figure 4B:
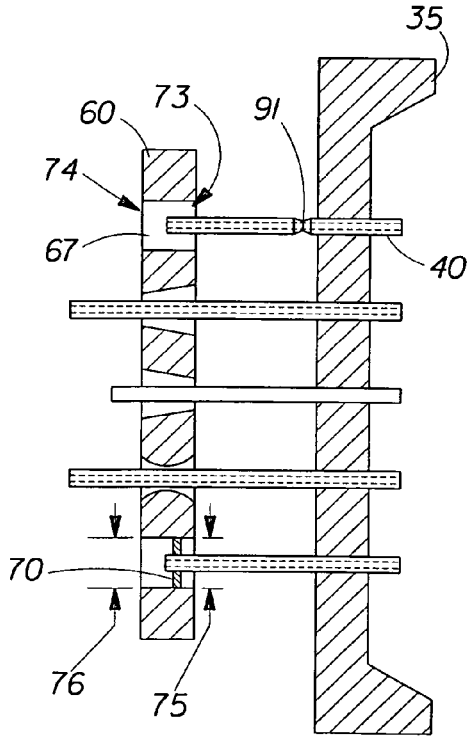
FIG. 4*b* is an enlarged, cross-sectional partial view of another embodiment of the die of the present invention with the individual elements spaced apart from each other so as to provide more detail.

As shown, for example, in FIGS. 1, 2 and 4*a*, the apparatus 10 of the present invention may also include a spacer plate 55 disposed adjacent at least a portion of the output surface 39 of the spinnerette body 35. The spacer plate 55 functions to direct the attenuation medium in a direction generally parallel to the nozzles 40 and to promote flow uniformity, as desired, throughout the attenuation area surrounding the nozzles 40. As such, the spacer plate 55 has a spacer plate opening 57 through which at least some of the nozzles 40 may extend.

The spacer plate 55 can be any suitable size and shape and can be made from any suitable material. Further, the spacer plate 55 can be a separate structure that is intended to be disposed adjacent a portion of the spinnerette body 35 or may be formed integrally with the spinnerette body 35 or any other portion of the apparatus 10. The spacer plate 55 includes a spacer plate opening 57 that provides an open area through which the nozzles 40 may pass and through which the attenuation medium will flow during operation. The spacer plate opening 57 may be rectangular or any other shape so as to fit about some or all of the nozzles 40. Further, spacer plate 55 may include more than one spacer plate opening 57, if desired.

The apparatus 10 of the present invention may also include a cover plate 60 disposed adjacent at least a portion of the spacer plate 55. The cover plate 60 has an upstream surface 62 and an opposed downstream surface 63 and will typically be disposed such that the upstream surface 62 is adjacent the surface of the spacer plate 55 that faces away from the spinnerette assembly 20. The cover plate 60 functions to direct the attenuation medium so as to help define shape of the attenuation medium jet and its location relative to the nozzles 40 as the attenuation medium exits the die 10. The cover plate 60 also provides a means for forming a pressure drop that helps encourage flow uniformity and velocity in the attenuation medium. As such, the cover plate 60 preferably has at least one cover plate opening 65 through which the attenuation medium may pass and/or into which one or more of the nozzles 40 may extend.

The cover plate opening 65 may comprise one or more attenuation medium holes 67 that together make up the cover plate opening 65. Each attenuation medium hole 67 has an upstream end 73, a corresponding upstream effective diameter 75, a downstream end 74 and a corresponding downstream effective diameter 76. (As used herein, the term "effective diameter," as it relates to an attenuation medium hole 67 is defined as four times the cross-sectional area of the hole 67 divided by the wetted perimeter of the hole 67.) As shown, for example, in FIGS. 4*a*, 4*b* and 5, the cover plate opening 65 may include individual attenuation medium holes 67 that surround each individual nozzle 40, or may be designed such that more than one nozzle 40 can pass through at least some of the attenuation medium holes 67. In such embodiments, it may be beneficial for each attenuation medium hole 67 to have an open area of at least about 0.064 square mm, although other embodiments are contemplated wherein the open area could be less than about 0.064 square mm.

Figure 5:
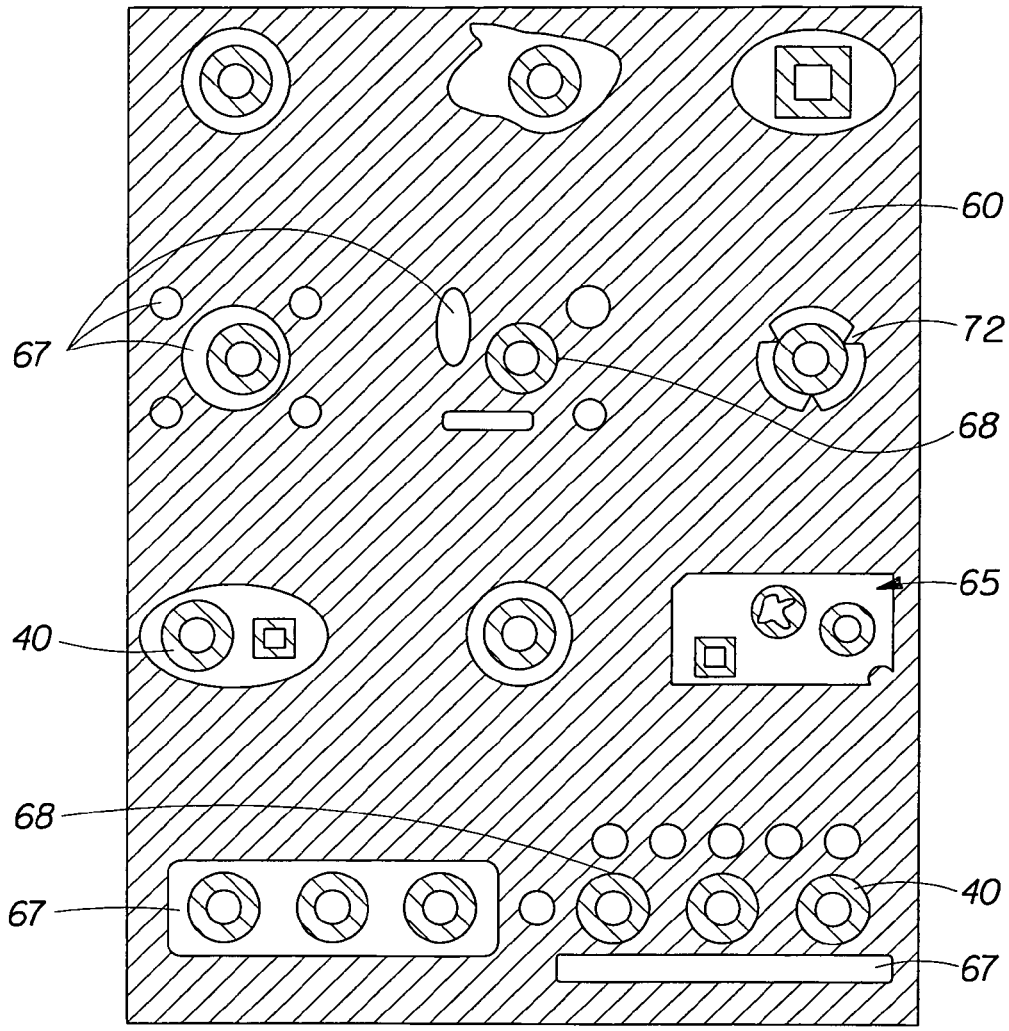
FIG. 5 is an enlarged, partial plan view of the cover plate of one exemplary embodiment of the present invention.

In alternative embodiments, at least some of the nozzles 40 may pass through the cover plate 60 in nozzle passages 68 that are separate from the attenuation medium holes 67, as shown in FIG. 5. The nozzle passages 68, the cover plate opening 65 and the attenuation medium holes 67 making up the opening 65 may be any desired size and/or shape, including circular and non-circular in cross-section, and may be tapered, chamfered and/or have rounded edges or other attributes. For example, the cover plate opening 65, any of the attenuation medium holes 67 and/or any of the nozzle passages 68 may have an upstream effective diameter that is larger than its downstream effective diameter or vice-versa, as shown, for example, in FIGS. 4*a* and 4*b*. Further, if there are two or more openings, holes or passages, any one or more of them may be different in size than any other one or more of the openings, passages or holes. If the nozzles 40 pass through the attenuation medium holes 67, the nozzles 40 may be centered within the holes 67 or may be offset in any desired direction. The attenuation medium holes 67 may be directed toward, away from or at any angle to any nozzle 40.

As noted above, the nozzles 40 may be of varying lengths relative to each other. Further, the nozzles 40 may also be designed such that they extend away from the supply cavity 25 different amounts in different die designs or within the same die. For example, it may be desirable that some or all of the nozzles 40 extend from the supply cavity 25 through the die 10 and beyond the cover plate 60. In alternative embodiments, it may be desirable to have some or all of the nozzles 40 extend into the cover plate opening 65, but not beyond the downstream surface 63 of the cover plate 65. It has been found that there is a non-linear relationship between the nozzle extension relative to the downstream surface 63 of the cover plate 65 and the effect on fiber characteristics. For example, in certain embodiments, nozzles 40 that extend between about 0 mm and about 2.2 mm beyond the downstream surface 63 of the cover plate 60 perform less desirably than nozzles 40 that extend further beyond the downstream surface 63 of the cover plate 60 or those that extend into the cover plate opening 65, but not beyond the downstream surface 63 of the cover plate 60.

In certain embodiments, it may be desirable to design the cover plate opening 65, any of the attenuation medium holes 67 and/or any of the nozzles 40 such that the fiber material and/or attenuation medium passing there through will rotate, spiral or be otherwise directed upon exiting the opening, hole or nozzle 40. This can be done by integrating a rifling structure into the nozzle 40 or the material surrounding the opening or hole. Alternatively, the fiber material flow and/or attenuation medium flow can be affected by additional structure such as, for example, the support elements 70, described below. If rotation of the attenuation medium or material stream is desired, it may be beneficial to limit the rotation to less than about 30 degrees to help avoid reversing the flow.

The cover plate 60 may be a separate element disposed adjacent a portion of the spacer plate 55 or spinnerette body 35 or may be integrally formed with the spacer plate 55 and/or spinnerette body 35 or any other portion of the apparatus 10. Further, the cover plate 60 may also include means for supporting the nozzles 40, such as the exemplary support elements 70, shown in FIG. 7. The support elements 70 provide support for the nozzles 40 and help ensure that the nozzles 40 do not become misaligned during use. This can help increase the uniformity of the fibers and any resulting end product, such as a fiber web that may be created.

Figure 7:
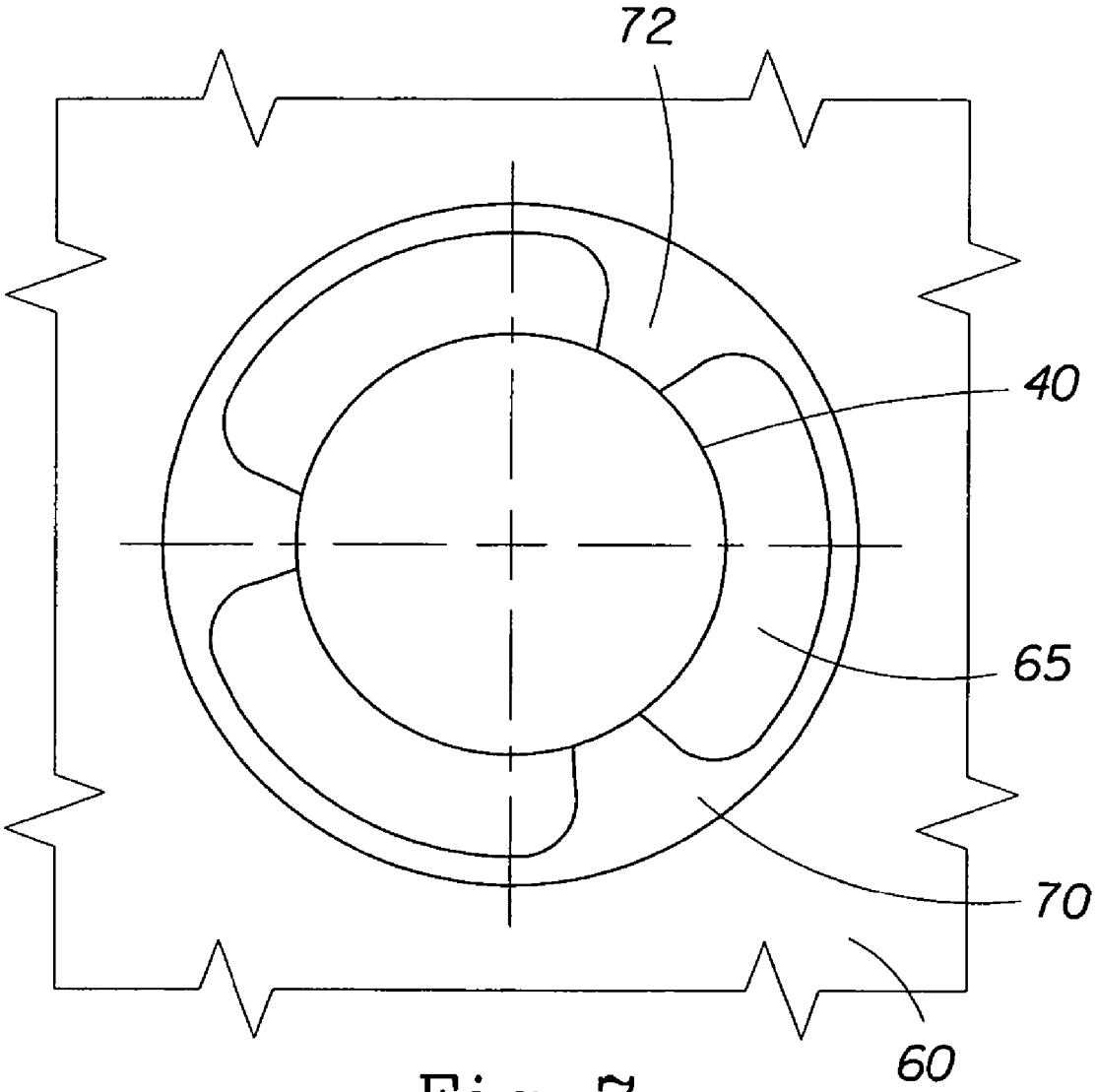
FIG. 7 is an enlarged, partial plan view of one embodiment of the apparatus of the present invention including a support element.
Figure 8:
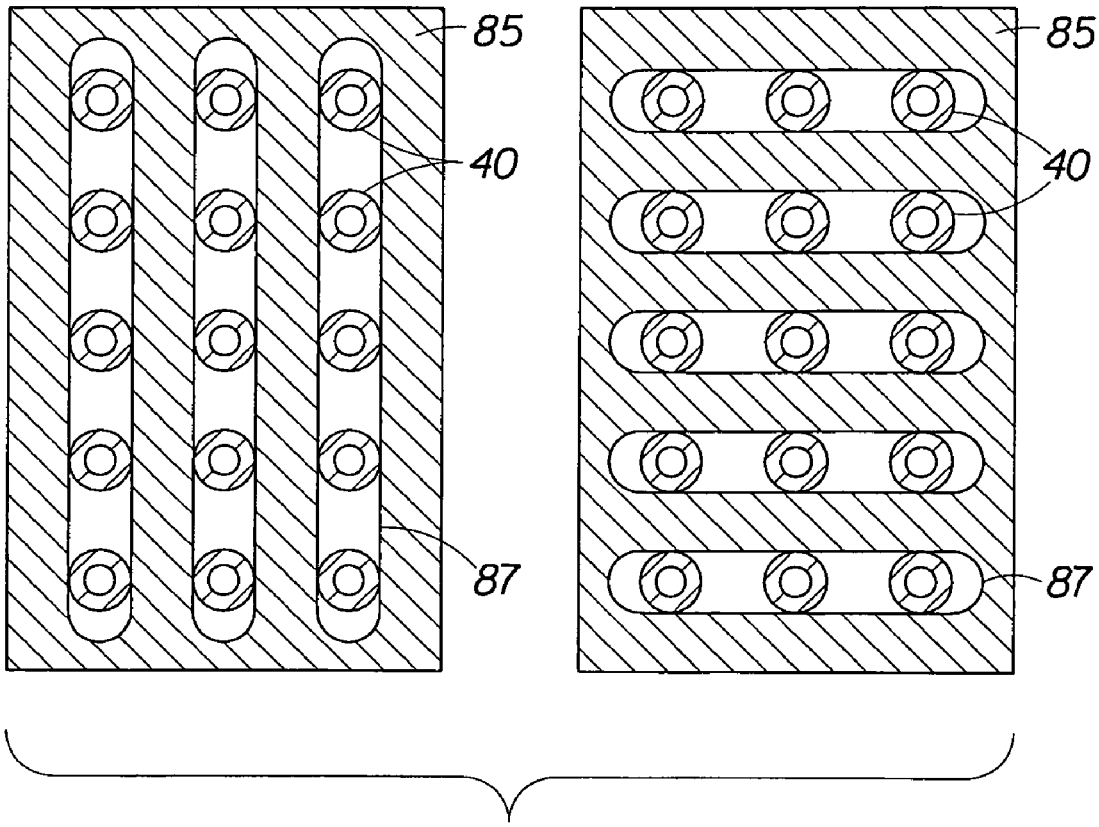
FIG. 8 is an enlarged plan view of one exemplary embodiment of a multi-piece support plate with the separate pieces separated from each other to show their individual detail.
Figure 9:
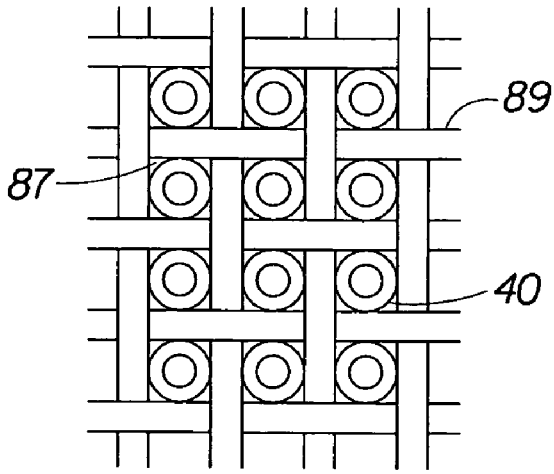
FIG. 9 is an enlarged, partial plan view of an exemplary embodiment of a screen type support element.

The support elements 70 can be made from any material and may be any suitable shape. Further, the support elements 70 may be separate elements or integral with the cover plate 60 or any other element of the apparatus 10. In one embodiment, as shown in FIG. 7, the support elements 70 may be in the form of one or more prongs 72 extending into the holes 67 of the cover plate opening 65 toward a corresponding nozzle 40 disposed in the hole 67. Although the support element 70 may touch the corresponding nozzle 40, it need not do so and may be located at any desired distance from the nozzle 40. The support element(s) 70 may also be disposed in a separate support plate 85 that is disposed adjacent the cover plate 60 (either upstream or downstream thereof) or any other structure of the die 10 such that at least some of the support elements 70 are aligned with at least some of the attenuation medium holes 67. In certain embodiments, the support plate 85 may comprise two or more plates that are used in conjunction with each other to provide support for the nozzles 40, examples of which are shown in FIG. 8. Alternatively, the nozzles 40 may be supported by a screen 89, one example of which is shown in FIG. 9, or other material. Typically, the support plate 85 includes attenuation medium openings 87 through which the attenuation medium can pass.

In certain embodiments of the present invention, it may be desirable to design some or all of the passages 80 through which the attenuation medium passes through the apparatus 10 in such a way that the overall pressure drop associated with the attenuation medium in the die 10 is relatively low as compared to prior art die designs. A reduction in pressure drop associated with the attenuation medium in the die 10 can be beneficial in a number of ways, including, but not limited to using less energy than is needed to manufacture similar fibers with a die having a higher pressure drop, providing the ability to make smaller diameter fibers, providing the ability to make more uniform fibers and/or to allow for better control of the relative solvent-vapor content of the attenuation medium.

The pressure versus flow behavior of an apparatus can be characterized using pressure drop coefficients. In this case, the pressure drop coefficient is defined by the ratio of measured or calculated pressure drop divided by the dynamic or velocity pressure of the attenuation medium stream. The measured pressure drop is the difference in pressure between a measurement point upstream of the die 10 and the room or atmospheric pressure, while the attenuation medium is flowing though the die 10. The dynamic pressure of the attenuation stream is $0.5\ \rho V^2$, where $\rho$ is the density of the attenuation medium and V is the average velocity in the flow channel. The attenuation stream density and velocity are defined as the average values inside the cover plate opening 65. Effectively, the velocity is determined by dividing the total volume of gas passing through the cover plate opening 65 by the limiting cross-sectional area of the cover plate opening 65. The density of a gas is dependent on the gas molecular composition, its temperature, and its pressure. It has been found that a pressure drop coefficient of less than about 4 is desirable to provide the advantages of the present invention. However, pressure drop coefficient values of less than about 3, less than about 2 and any individual or range of pressure drop coefficient values below about 4 works well.

It has been found that a significant reduction in the pressure drop associated with the attenuation medium in the die 10 may be provided by decreasing the velocity of the attenuation medium in the die 10. One way to provide reduced velocity in the die 10 is to incorporate attenuation medium passages 80 in the die 10 with relatively large minimum cross-sectional areas as compared to the limiting cross-sectional area of the opening through which the attenuation medium exits the die 10. The relatively large cross-section passages and reduced velocity can help decrease the pressure drop within the die 10 due to a number of factors, including a decrease in friction and reduced flow separation and turbulence. As used herein, the terms "attenuation medium passages" and "attenuation medium channels" both refer to any of passages through which the attenuation medium passes while in the die 10 upstream of the cover plate opening 65. The term "cross-sectional area", as used herein in relation to an attenuation medium passage or opening, is the cross-sectional area of the passage or opening taken substantially perpendicular to the direction of attenuation medium travel in the passage or opening. The cross-sectional area of an opening or passage having some structure located within the passage or channel is the cross-sectional area that is open to attenuation medium flow and thus, the cross-sectional area of any structure located within the cross-section of the opening or passage should be subtracted. The term "minimum cross-sectional area" is the sum of the smallest cross-sectional area measurements of all of the individual attenuation medium passages 80 within the die 10 taken substantially perpendicular to the direction of attenuation medium travel in the particular passage. The term "limiting cross-sectional area" refers to the smallest cross-sectional area of the cover plate opening 65 taken in a single plane. If the cover plate opening 65 includes more than one opening, the limiting cross-sectional area is a sum of the smallest cross-sectional measurements of each individual attenuation medium hole 67 taken substantially perpendicular to the direction of the attenuation medium travel in the particular hole 67.

In certain embodiments, it has been found that designing the attenuation medium passages 80 such that the minimum cross-sectional area of the passages 80 is greater than the limiting cross-sectional area of the cover plate opening 65 is beneficial. By designing the attenuation medium passages 80 to be larger in minimum cross-sectional area than the limiting cross-sectional area of the cover plate opening 65, the velocity of the attenuation medium in the attenuation medium passages 80 will typically be lower than the velocity of the attenuation medium exiting the die 10 through the cover plate opening 65. Generally, the lower the velocity of the attenuation medium within the die 10, the lower the pressure drop associated with the attenuation medium in the die 10. In certain preferred embodiments, the minimum cross-sectional area of the attenuation medium passages 80 would be at least about two times or at least about four times the limiting cross-sectional area of the cover plate opening 65.

Further, it has been found that progressively decreasing the cross-sectional area of the attenuation medium passages 80 as one moves from the attenuation medium inlet 30 toward the cover plate opening 65 can help decrease the pressure drop within the die 10. However, it is understood that there may be circumstances where a contraction in cross-sectional area followed by an expansion in cross-sectional area is desirable. For example, the contraction and expansion will create a pressure drop within the attenuation medium passage 80 that can be used to distribute the attenuation medium uniformly across the width of the passage 80, or an opening, or otherwise affect a change in the attenuation medium flow. In certain embodiments, it may be desirable to maintain good uniformity of flow of the attenuation medium as it exits the cover plate opening 65. In such cases, the velocity of the flow, the flow rate and the direction of the attenuation stream exiting the die 10 should be matched as much as possible to produce uniform fibers and fiber webs. Progressive decreases in the cross-sectional area of the attenuation medium passages help provide uniformity by concentrating the pressure drop in the die 10 at the cover plate 60.

Other ways to help reduce the pressure drop associated with the attenuation medium in the die 10 is to use relatively smooth curved or rounded cross section shapes for the attenuation medium passages 80. Additionally, the pressure drop can be reduced by ensuring that the attenuation medium passages 80 avoid tight, small radius, turns. A tight turn will behave like a sharp corner, producing unwanted flow separations, velocity fluctuations and flow non-uniformities. In certain embodiments, it has been found that turns having an inner radius of greater than about one quarter of the width of the channel in the plane of the turn work well to prevent unwanted pressure drops associated with such turns.

In embodiments where the die 10 consists of multiple, independent parts, it may be advantageous to carefully align the attenuation medium passages 80 to produce smooth flow passages. If the individual parts are mis-aligned, sharp edges or other non-uniformities may be introduced into the flow path of the attenuation medium, which may disrupt or otherwise affect the attenuation medium flow. In certain embodiments, it is preferred to mechanically pin the different parts of the die 10 together so as to ensure that they do not become misaligned during die assembly or use. In certain preferred embodiments including parts having matching material or attenuation medium passages at their mating surfaces, it may be desirable to align the passages within about 0.03 mm along their mating surfaces. Further, it is generally desirable to hold such mating surfaces flush to one another to achieve a seal and preventing flow leakage.

As noted above, one advantage of the apparatus and method of the present invention is that the relative solvent-vapor content of the attenuation medium can be more easily controlled than when using a conventional die. For example, it has been found that the method and apparatus of the present invention can provide an attenuation medium stream having a relative vapor-solvent content of at least about 50%, of at least about 60%, of at least about 75% and greater than at least about 75%. Thus, the improved apparatus and method of the present invention are especially advantageous when fibers are being formed from materials that have some characteristic that can be affected by a solvent present in the attenuation medium. For example, some non-thermoplastic materials used in fiber making may be affected by the amount of humidity in the attenuation medium. (It should be noted that although humidity (i.e. water vapor) is being used herein to describe one particular solvent that may be found in the attenuation medium (e.g. air), other solvents and attenuation media are contemplated and expected for use with different fiber materials.) Further, other materials that heretofore have not been suitable for commercial manufacture into fibers due to process limitations related to the amount of humidity or other solvent-vapor content in the attenuation medium can be more effectively formed into fibers with the apparatus and method of the present invention.

Starch is one example of a material that would be advantageous to use in fiber making due to its availability, cost and recyclable nature. Examples of starch-based compositions suitable for fiber making and methods for making fibers and webs from such composition are described in U.S. Ser. No. 09/914,966, filed Sep. 6, 2001 in the names of Mackey et al.; U.S. Ser. No. 10/062,393, filed Feb. 1, 2002 in the names of Mackey et al.; U.S. Ser. No. 10/220,573, filed Sep. 3, 2002 in the names of Mackey et al.; and U.S. Ser. No. 10/061,680, filed Feb. 1, 2002 in the names of James et al. However, despite the advancements made with respect to the formulation of starch-based materials useful for fiber making, because starch is generally non-thermoplastic and water soluble, typical fiber making dies are not very effective in making commercially viable starch fibers. Another example of a material suitable for use in fiber making that may be affected by the solvent-vapor content of the attenuation medium is polyvinyl alcohol. When making fibers from materials like starch and polyvinyl alcohol, ensuring that the attenuation medium has sufficient relative solvent-vapor content after it exits the die 10 can help reduce or prevent the fiber material from drying too quickly and/or sticking to the end of the spinnerette nozzles 40.

If the attenuation medium is air, the amount of water vapor (or other solvent) that can be held by the air is determined by the pressure and temperature of the air, according to generally accepted thermodynamic principles. In general, air is capable of holding more water vapor as its temperature increases at a given pressure. Likewise, air can hold more water vapor as its pressure decreases at any given temperature. When air is saturated (i.e. holding the maximum amount of water vapor that it can at that particular temperature and pressure), a slight drop in temperature or a slight increase in pressure can cause the water vapor (or other solvent) in the air to condense.

Fiber forming dies that use an attenuation medium to stretch or otherwise affect the forming fibers typically pressurize the attenuation medium so that it can be discharged from the die 10 at a relatively high velocity versus the fiber strands. Thus, when the attenuation medium exits the die 10, it generally undergoes a rapid pressure drop. If the attenuation medium contains a solvent, relative solvent-vapor content in the attenuation medium decreases with the pressure drop. For a given attenuation medium stream, the absolute amount of solvent vapor does not change as a result of the pressure drop, but rather, the equilibrium level of the of the solvent increases with the pressure drop, and thus, the relative solvent-vapor content decreases. This can make it more difficult to effectively attenuate the fibers and may lead to breakage or misformed fibers. Further, the fact that the pressure drop causes such a decrease in relative solvent-vapor content may require that the attenuation medium have a higher concentration of solvent prior to exiting the die 10. Accordingly, in some cases, it may be necessary or desirable to saturate or otherwise increase the amount of the solvent in the attenuation medium prior to or during the time when the attenuation medium is in the attenuation medium passages 80 of the die 10. In one example, where water is the solvent, it may be desirable or necessary to treat the attenuation medium with steam prior to its entering the die assembly 15 to increase its relative humidity. This can add material and energy costs and can increase the number of process steps necessary to form suitable fibers. It can also reduce the overall reliability of the process and/or require extra monitoring steps.

Figure 10:
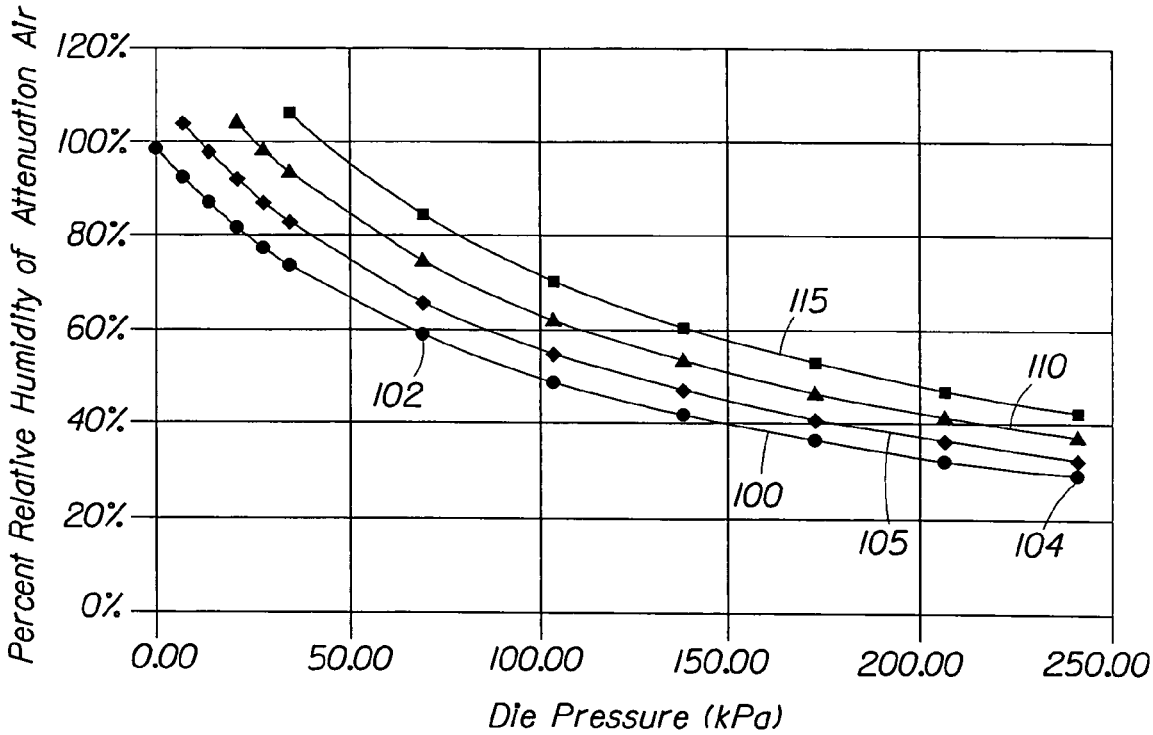
FIG. 10 is a graphical representation of the relationship between percent relative humidity of attenuation air at the die exit (vertical axis) and the die pressure (horizontal axis).
Figure 11:
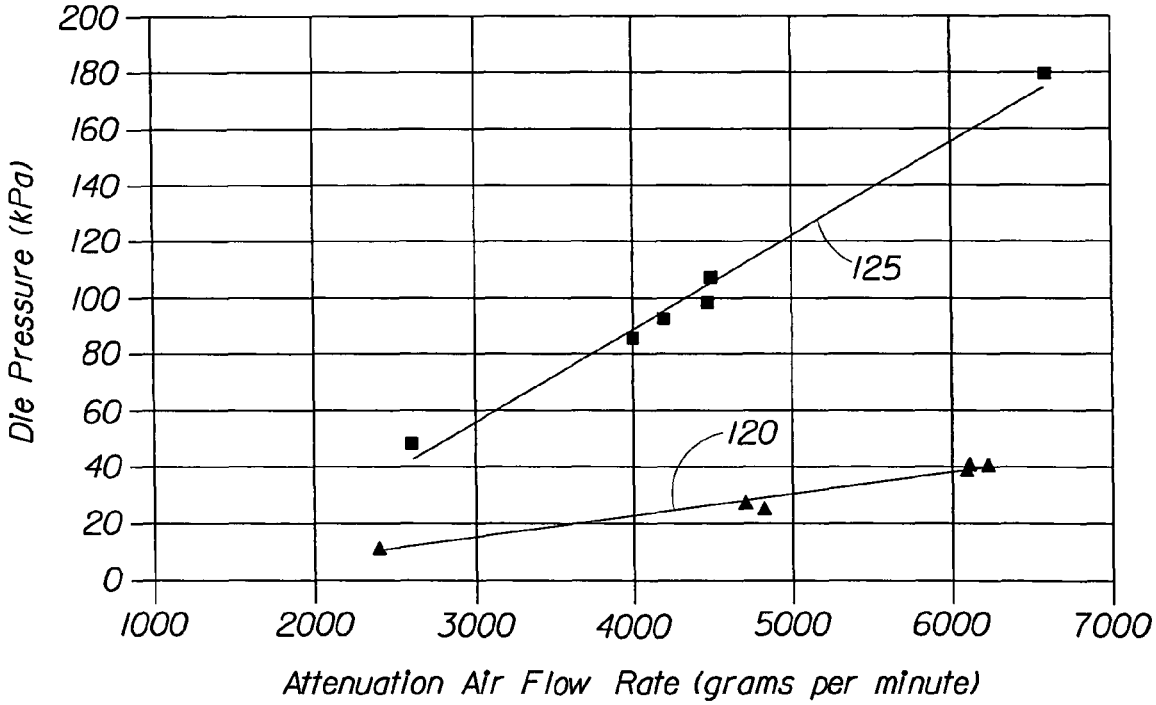
FIG. 11 is a graphical representation of the relationship of the flow characteristics of certain fiber forming dies, wherein the vertical axis represents the die pressure and the horizontal axis represents the attenuation flow rate.
Figure 12:
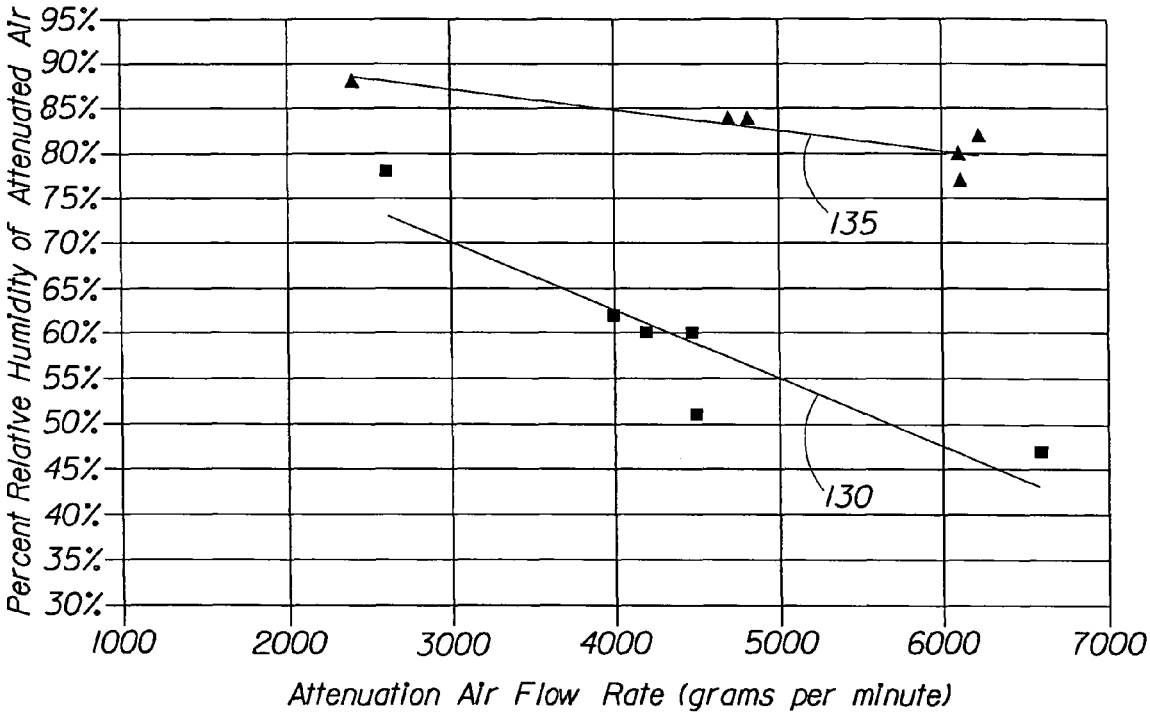
FIG. 12 is a graphical representation of the relationship between the percent relative humidity of the attenuation air stream from certain fiber forming dies (vertical axis) and the attenuation flow rate (horizontal axis).

The graphical representations in FIGS. 10-12 are intended to help show how the apparatus 10 of the present invention providing for a reduced pressure drop in the attenuation medium when it exits the die 10 can improve the performance of the apparatus versus conventional dies, especially when used to make fibers from materials that are non-thermoplastic, but rather are soluble. In the examples shown in FIGS. 10-12, the attenuation medium has been chosen to be air and the solvent is water.

FIG. 10 is a graph showing the percent relative humidity (% RH) of the attenuation air at the exit of the apparatus versus the die pressure. As used herein, the "die pressure" is the difference between the maximum pressure of the attenuation air in the die 10 upstream of the spinnerette 20 and the pressure of the attenuation air after it exits the die 10 (typically atmospheric pressure). In each depicted scenario, the attenuation air is saturated before it is pressurized in the die 10, and thus, the percent relative humidity is approximately 100%. The vertical axis is the percent relative humidity of the attenuation air at the exit of the die 10. The horizontal axis is the die pressure (or gauge pressure) shown in units of Kilo-Pascals (KPa). For the purposes of this graph and the disclosure herein, the pressure of the attenuation medium after it exits the die 10 should be considered the pressure of the environment surrounding the nozzles 40 into which the attenuation medium will be directed.

As shown in FIG. 10, if the temperature of the air remains constant in the die and through the pressure drop as it exits the apparatus, the percent relative humidity follows a curve such as the curve labeled 100 in FIG. 10. Thus, for example, if there is a zero pressure difference between the die pressure and the environment surrounding the nozzles and attenuation air is saturated or near saturated, (for example 98% or greater RH), the attenuation air will remain saturated or near saturated upon exit from the die 10. However, as the pressure drop increases, the percent relative humidity at the attenuation medium exit 22 will decrease. Thus, for example, as shown in FIG. 10, the % RH value of the attenuation air at attenuation medium exit 22 is close to 60 percent at a 69 KPa pressure drop. This point is labeled 102 in FIG. 10. Similarly, the relative humidity drops to about 30 percent if the pressure drop is about 241 KPa. This point is labeled 104 in FIG. 10.

FIG. 10 also shows how the attenuation air will act if the temperature of the air decreases at or about the attenuation medium exit 22. As noted above, in general, as temperature is lowered at a given pressure, air can hold less water vapor. Thus, air with a given amount of water vapor at a higher temperature will have a lower relative humidity than the same air at a lower temperature. Accordingly, three different curves are shown in FIG. 10 showing how a change in temperature and pressure will affect the percent relative humidity of the attenuation medium. Curve 105 depicts what happens for a 2.8° C. loss in temperature, curve 110 depicts what happens for a 5.6° C. loss in temperature and curve 115 depicts what happens for a 8.3° C. loss in temperature.

FIG. 11 is a graph that relates die pressure to attenuation medium flow rate. The pressure-flow curves of FIG. 11 represent the values generated from a commercially available 5 inch (about 12.7 cm) wide, 10 row die from Biax-Fiberfilm Corporation, N992 Quality Drive Suite B, Greenville, Wis. 54942-8635 and an embodiment of the present invention having a similar 5 inch (about 12.7 cm) wide die having 10 rows of nozzles. The die pressure was measured using a pressure transducer located in an attenuation medium passage in the die 10 upstream of the spinnerette assembly 20. The "dry" attenuation air flow rate and the steam flow rate are both measured using standard Corriolis type mass flowmeters. The total attenuation air mass flow rate is the sum of the steam flowrate and "dry" air flowrate. The pressure flow curve of FIG. 11 shows that the low pressure drop die of the present invention (curve 120) operates at much lower die pressures for the same range of attenuation flow rates as the commercially available die (curve 125). Thus, the apparatus of the present invention will use less die pressure to accelerate the attenuation medium to the desired velocity and thus, less energy and will also allow higher humidity levels in this air stream. The higher humidity levels decrease the rate of solvent loss, or drying, of the fibers near the die. The lower drying level allows for greater extension of the fibers, and thus, for the creation of smaller fibers.

FIG. 12 shows relationship between percent relative humidity of the attenuation air and the attenuation flow rate for the same die assemblies described with respect to the graph in FIG. 11. One suitable method for measuring relative humidity via wet and dry bulb measurements is described below. The percent relative humidity versus flow curves show that the die exit percent relative humidity values of the attenuation air of the die of the present invention (curve 135) are much higher than what is generated by a commercially available die (curve 130) within the same flow rate range. Thus, at the same die pressure and exit relative humidity, a larger quantity of attenuation air can be expelled through the die 10. The larger quantity of air can produces higher air velocities in the resulting attenuation air stream. The increased air velocities can generate greater forces on the filaments and create smaller fibers.

An additional means for increasing the attenuation medium's relative solvent-vapor content is to cool the attenuation medium. The effect of cooling the attenuation medium on its relative solvent-vapor content can be seen in the graph of FIG. 10. In general, as a gas is cooled at a fixed pressure, the relative solvent-vapor content (in this case humidity) of the gas will increase. Thus, less solvent vapor will be needed to provide the desired relative solvent-vapor content level in a gas that is cooled versus one that is at an elevated temperature. However, any cooling should be controlled carefully to avoid liquid condensation.

One way to provide cooling to the attenuation medium stream is to add a cooling medium channel to the die 10 and feed a cooling medium through the cooling channel and direct the cooling medium onto the attenuation medium within the die 10. Alternatively, the cooling of the attenuation medium stream may also occur external to the die 10. In such embodiments, the cooling medium may be directed onto the cover plate 60 or other portion of the die 10 where the attenuation medium stream exits the die 10. In yet other embodiments, the cooling medium may be provided in a closed system of flow channels or other structure through which the attenuation medium may pass so as to provide cooling without actually mixing with the attenuation medium. In any case, it is preferred that all or a majority of the cooling occur after the attenuation medium has realized a pressure drop. If not, the cooling may cause excessive condensation to occur, especially when the attenuation medium is saturated or nearly saturated.

The cooling medium may be any suitable gas, liquid or mixture thereof. Further, the system to provide the cooling medium may be passive or active. In a passive system, the cooling medium is entrained into the attenuation medium stream by the action of the attenuation medium only. An active system uses some means other than or in addition to the forces created by the attenuation medium stream to force the cooling medium into the attenuation medium stream. Other known cooling systems may be equally desirable and effective. In any case, it may be desirable to provide insulation between the attenuation medium passages and the cooling medium and/or means to ensure that the respective temperatures of the cooling medium and the attenuation medium are maintained until they are combined.

Regardless of the die type, in certain embodiments, the design of the die and/or the make-up of the attenuation medium may result in some condensation in the die 10 and/or at the attenuation medium exit 22. Thus, there is often a need for some system to collect or otherwise deal with the condensation. Failure to do so can result in reduced efficiency, lower levels of relative humidity or solvent-vapor content in the attenuation medium and/or the possibility of broken fibers or other non-uniform regions in the fibers.

One way to reduce the possibility of side effects associated with condensation is to control the temperature of the die 10 and the ducting leading to the die assembly 15. A heated surface having a temperature that is the same as or warmer than the attenuation medium stream will generally not cause condensation to occur. In certain embodiments, insulation may be used, as desired, to minimize the loss of heat across any surface or surfaces. In addition or as an alternative, active heating can be used on some or all of the parts of the die 10. Heating can be accomplished by circulating a heated fluid, such as oil, through passages or channels in and around the die 10 and ducting. Similarly, electrical heating elements or heat tape can be used for the same purpose. Of course, any other known means for heating the die 10 or any portions thereof can be implemented.

A second approach to reduce the effect of condensation is to trap and preferably remove the condensate from the attenuation medium stream. Although it is generally desirable to place such traps as close to the cover plate opening 65 as possible in order to remove the most condensate, the traps can be located anywhere in the die 10 or in the ducting leading to the die 10. One type of trap functions by forcing the attenuation medium to sharply change direction. The condensate cannot make the turn and is deposited onto the walls of the trap. The condensate can then be evacuated by a drain, weep holes or other structure, while the attenuation medium is allowed to continue toward the cover plate opening 65.

Exemplary Die Embodiment

One exemplary embodiment of the apparatus 10 of the present invention includes a spinnerette assembly 20 having a generally rectangular grid of capillary nozzles 40, spaced at about 1.52 mm centers in both the horizontal and vertical directions. The nozzles 40 are laid out in a grid of 10 rows and 82 columns, yielding 820 nozzles in total. The nozzles 40 are approximately 0.81 mm in outer effective diameter, with an inner effective diameter of approximately 0.25 mm. The nozzles 40 extend from the supply cavity 25 of the die assembly 15 toward the discharge opening 50 of the die assembly 15. The nozzles 40 are each about 31.8 mm long and extend approximately 2.5 mm beyond the cover plate 60.

The attenuation medium enters the die assembly 15 through four generally rectangular cross-section attenuation medium inlet holes 30. The four attenuation medium inlet holes 30 have rounded corners and minimum cross-sectional dimensions of about 20.1 mm by about 38.1 mm, resulting in a total cross-sectional area of about 3071 square mm.

The die assembly includes a spacer plate 55 disposed adjacent the output surface 39 of the spinnerette body 35. The spacer plate 55 in this exemplary embodiment is about 2.5 mm thick. The center region of the spacer plate 55 has a generally rectangular slot removed to produce an opening 57 through which the nozzles 40 extend and the attenuation air flows. The spacer plate opening 57 measures about 17.8 mm by about 127.0 mm producing a cross-sectional area for airflow of about 1832 square mm, once the area of the capillary nozzles 40 is subtracted from the total cross-sectional area of the spacer plate opening 57.

The die assembly 15 also includes a cover plate 60 made from a steel plate that is about 1.9 mm thick. The cover plate 60 has a cover plate opening 65 comprising a number of holes 67 drilled through the cover plate 60. The holes 67 are disposed in a rectangular grid matching the nozzle 40 pattern (i.e. square grid of 10×82 holes spaced at about 1.52 mm centers). The holes 67 of the cover plate opening 65 are each tapered so as to provide a hole 67 having an upstream effective diameter of about 1.18 mm and a downstream effective diameter of about 1.40 mm. The resulting attenuation flow area about each nozzle 40 is the doughnut shaped orifice created between the about 0.81 mm diameter nozzle 40 and the about 1.18 mm outer effective diameter hole 67 in the cover plate 60. Thus, each hole has an open area of about 0.57 square mm. The resulting limiting cross-sectional attenuation area of the cover plate opening 65 is about 471 square mm in total. A cover plate 60 with integrated support prongs 72, as described above and shown in FIG. 7, has also been used and has a cover plate opening limiting cross-sectional area of about 458 square mm for the same hole pattern of 10×82 holes spaced at about 1.52 mm centers.

The relative minimum cross-sectional area of the attenuation medium passages to the cover plate opening limiting cross-sectional area is greater than one. In this exemplary embodiment, the minimum cross-sectional area of the attenuation passages is located at the spacer plate and the ratio of the minimum cross-sectional area of the attenuation medium passages to the cover plate opening limiting cross-sectional area is about 3.9 to 1.

Exemplary Method of Making Fibers

For the purpose of this exemplary embodiment, a die 10 having nozzles 40 regularly spaced at about 1.52 mm centers in a grid of ten rows and eighty-two columns is used to create fiber strands from a fiber making material. The fiber making material is a composition of Ethylex 2025 starch (available from A.E. Staley Mfg., a division of Tate and Lyle, 2200 E. Eldorado, Decatur, Ill. 62525) and water (solvent), containing about 46 percent water on a mass basis. The fiber making material is prepared by cooking or destructuring the starch in an extruder. The extruder may be operated such that the composition reaches a peak temperature of about 160° C. The fiber making material is fed into the nozzles of the die at a pressure of about 8300 Kpa and a temperature of about 70° C. When the fiber making material exits the die 10, it is in the form of continuous fiber strands.

An attenuation medium of heated air is provided in a direction generally parallel to the fiber strands that are exiting the die 10. The attenuation medium includes a combination of about 2500 grams per minute of air heated to 93° C. and about 500 grams per minute of steam at 133° C. The attenuation medium passes through attenuation medium passages in the die that together have a minimum cross-sectional area of about four times the limiting cross-sectional area of the cover plate opening. The pressure drop coefficient for the internal portions of the die is about 1.4. The attenuation medium passes through a condensate separator before entering the die 10 to remove unwanted liquid water. The attenuation medium has a temperature of about 69° C. and generates a gauge pressure of about 26 KPa at the entrance of the die body. At the die exit 22, the attenuation medium returns to atmospheric pressure and has a measured relative humidity of about 82 percent.

The total pressure drop coefficient for the die 10 of the present invention is between about 1 and about 2, for example, as compared to compared a total pressure drop coefficient of between about 4 and about 5 for a commercially available 5 inch (about 12.7 cm) wide, 10 row die from Biax-Fiberfilm Corporation having a similar limiting cross-sectional open area in the cover plate. These measured pressure drop coefficients correspond to attenuation medium velocities ranging from about 90 to about 350 meters per second.

After the fibers strands leave the die, the fibers are dried by the addition of about 9000 grams per minute of air heated to a temperature of about 260° C. The drying air is fed through a pair of drying ducts, each about 360 mm wide by 130 mm deep. The drying air is directed generally perpendicular to the fiber strands leaving the die, the ducts positioned on opposite sides of the die. The leading edges of the drying ducts are positioned about 80 mm downstream of the cover plate of the die and about 130 mm from each other. The fibers pass between the two drying ducts. The resulting dried fibers have an average diameter of less than about 12 microns. As desired, the dried fibers are deposited on a moving structure, such as a belt, to form a web. (The moving structure may be any suitable structure and may include, for example, any known belt or foraminous structure commonly used in fiber web making or any structured or non-structured belt or clothing commonly used, for example, in papermaking.)

In an alternative embodiment, the attenuation medium is cooled upon leaving the die. The cooling is performed by means of forcing cool air into the attenuation medium stream. The temperature of the cooling air is about 35° C. In this particular embodiment, the cooling air is forced into the attenuation medium stream at a rate of about 10 percent of the attenuation medium stream flow rate. After being cooled to about 66° C., the mixture of attenuation air and the cooling medium has a relative humidity of about 75 percent.

Method for Measuring Relative Humidity

When the solvent is water, the relative humidity can be determined using wet and dry bulb temperature measurements and an associated psychrometric chart. Wet bulb temperature measurements are made by placing a cotton sock around the bulb of a thermometer. The thermometer, covered with the cotton sock, is placed in hot water until the water temperature is higher than the anticipated temperature of the wet bulb. The thermometer is placed in the attenuating air stream, at about 3 millimeters (about ⅛ inch) from the tips of the extrusion nozzles. The temperature will initially drop as the water evaporates from the sock. The temperature will plateau at the wet bulb temperature and begin to climb once the sock loses its remaining water. The plateau temperature is the wet bulb temperature. If the temperature does not decrease, the water should be heated to a higher temperature. The dry bulb temperature is measured using a 1.6 mm diameter J-type thermocouple placed at about 3 mm downstream from the extrusion nozzle tip. Based on the wet and dry bulb temperatures, the relative humidity can be determined from a standard atmospheric psychrometric chart or a computer program, such as, for example an Excel™ plug-in like "MoistAirTab" available from ChemicaLogic Corporation.

If the solvent is not water, the relative solvent-vapor content can be measured using principles similar to those discussed above for determining relative humidity. However, whereas the psychrometric ratio for a system of air and water vapor can be taken as 1, the ratio for other systems generally does not equal 1. Thus, the adiabatic-saturation temperature will be different from the wet bulb temperature. Accordingly, for systems other than air and water vapor, determination of solvent-vapor content and drying generally requires point-to-point calculation of temperature of the evaporation surface. For example, for an air and water system, the temperature of the evaporating surface will be constant during the constant-rate drying period, even though the temperature and humidity of the gas stream change. For other systems, the temperature of the evaporating surface will change, and thus, the temperature of the evaporating surface must be calculated for each point. See Robert H. Perry, *Perry's Chemical Engineers' Handbook*, Fourth Edition, page 15-2, published in 1969 by McGray-Hill Book Company.

All documents cited in the Detailed Description of the Invention are, in relevant part, incorporated by reference herein; the citation of any document is not to be construed as an admission that it is prior art with respect to the present invention. To the extent that any meaning or definition of the term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for creating fibers from a material dissolved in a solvent, the method including the following steps:

feeding a starch fiber making material comprising starch dissolved in a solvent through a die including a spinnerette having at least two rows of nozzles to form fiber strands and one or more attenuation medium passages having a minimum cross-sectional area for providing an attenuation medium about the fiber strands, the die further including a cover plate disposed adjacent at least a portion of the spinnerette, the cover plate having therein a cover plate opening into which one or more of the nozzles may extend, the cover plate opening having a limiting cross-sectional area wherein the minimum cross-sectional area of the one or more attenuation medium passages is greater than the limiting cross-sectional area of the cover plate opening; and providing an attenuation medium through the one or more attenuation medium passages and about the fiber strands, the attenuation medium being provided in a direction that is generally parallel to the fiber strands such that the attenuation medium elongates the fiber strands, the attenuation medium having a relative solvent-vapor content of at least about 50 percent and wherein the attenuation medium experiences a pressure drop prior to contacting the fiber strands.

2. The method of claim 1 wherein the relative solvent-vapor content is at least about 60 percent.

3. The method of claim 1 wherein the starch fiber making material is non-thermoplastic.

4. The method of claim 3 wherein the solvent is water.

5. The method of claim 4 wherein the starch fiber making material further comprises polyvinyl alcohol.

6. The method of claim 1 wherein the attenuation medium is provided through a cover plate opening at a velocity of between about 90 and about 350 m/s, and wherein the attenuation medium has a pressure drop coefficient of less than about 4.

7. The method according to claim 1 wherein the attenuation medium is cooled after experiencing the pressure drop.

8. The method of claim 1 wherein the starch fiber making material is forced through nozzles having different lengths and/or different diameters producing differential melt flowrates in the nozzles.

9. The method of claim 1 wherein the die includes a cover plate having attenuation medium holes through which the attenuation medium flows, and wherein the attenuation medium holes have varying shapes and/or diameters so as to produce differential attenuation medium flowrates.

10. A method for creating fibers from a material dissolved in a solvent, the method including the following steps:

feeding a starch fiber making material comprising starch dissolved in a solvent through a die including a spinnerette having at least two rows of nozzles to form fiber strands and one or more attenuation medium passages having a minimum cross-sectional area for providing an attenuation medium about the fiber strands, the die further including a cover plate having a cover plate opening into which one or more of the nozzles may extend, the cover plate opening having a limiting cross-sectional area wherein the minimum cross-sectional area of the one or more attenuation medium passages is greater than the limiting cross-sectional area of the cover plate opening;

providing an attenuation medium through the cover plate opening at a velocity of between about 90 and about 350 m/s, the attenuation medium being provided in a direction that is generally parallel to the fiber strands such that the attenuation medium elongates the fiber strands; and wherein the attenuation medium experiences a pressure drop prior to contacting the fiber strands and has a pressure drop coefficient of less than about 4.

11. The method of claim 10 wherein the attenuation medium has a pressure drop coefficient of less than about 3.

12. The method of claim 10 wherein the attenuation medium has a relative solvent-vapor content of at least about 50 percent.

13. The method of claim 10 wherein the starch fiber making material is non-thermoplastic.

14. The method of claim 10 wherein the starch fiber making material further comprises polyvinyl alcohol.

15. The method of claim 10 wherein the attenuation medium is cooled after experiencing the pressure drop.

16. A method for creating fibers from a material dissolved in a solvent, the method including the following steps:

feeding a starch fiber making material comprising starch dissolved in a solvent through a dies including a spinnerette having one or more nozzles to form fiber strands and one or more attenuation medium passages having a minimum cross-sectional area for providing an attenuation medium about the fiber strands, the die further including a cover plate having a cover plate opening into which one or more of the nozzles may extend, the cover plate opening having a limiting cross-sectional area wherein the minimum cross-sectional area of the one or more attenuation medium passages is greater than the limiting cross-sectional area of the cover plate opening;

providing an attenuation medium through the one or more attenuation medium passages and about the fiber strands, the attenuation medium being provided in a direction that is generally parallel to the fiber strands such that the attenuation medium elongates the fiber strands, the attenuation medium experiencing a pressure drop prior to contacting the fiber strands; and cooling the attenuation medium after the attenuation medium experiences the pressure drop.

17. The method of claim 16 wherein the starch fiber making material is fed into a die having two or more rows of nozzles.

18. The method of claim 16 wherein the attenuation medium is provided through a die including the nozzles and one or more attenuation medium passages, and wherein the attenuation medium is cooled upon exiting the die.

19. The method of claim 16 wherein cool air is mixed with the attenuation medium to provide the cooling.

20. The method of claim 16 wherein the attenuation medium has a relative solvent-vapor content of at least about 50 percent after being cooled.

* * * * *